US005254011A

United States Patent [19]

Ishikura et al.

[11] Patent Number: 5,254,011

[45] Date of Patent: Oct. 19, 1993

[54] CABLE CONNECTING AND DISCONNECTING APPARATUS FOR SUBMERGED PUMP

[75] Inventors: Kazuo Ishikura; Yuichiro Miura, both of Tokyo, Japan

[73] Assignee: Nikkiso Co., Ltd., Tokyo, Japan

[21] Appl. No.: 860,416

[22] Filed: Mar. 30, 1992

[30] Foreign Application Priority Data

Mar. 30, 1991 [JP] Japan ..... 3-67331

[51] Int. Cl.[5] ..... H01R 13/523

[52] U.S. Cl. ..... 439/198; 417/422

[58] Field of Search ..... 439/190-201; 174/21 R, 21 JS; 417/422

[56] References Cited

U.S. PATENT DOCUMENTS 2,897,763 8/1959 Wright ..... 417/422
3,041,977 7/1962 Boyd ..... 417/422
4,054,351 10/1977 Gallay et al. ..... 439/198

*Primary Examiner*—Neil Abrams

*Attorney, Agent, or Firm*—Young & Thompson

[57] ABSTRACT

A cable connecting and disconnecting apparatus for a submerged pump for connecting and disconnecting a liquid side power cable with an atmosphere side power cable, comprises a liquid side terminal header, an atmosphere side terminal header, and a liquid-tight intermediate container detachably secured between the headers. The intermediate container has therein a pair of partitions, and an insulating tube disposed within the intermediate container extends between the partitions and defines with the partitions an air-tight chamber within the intermediate container and outside the insulating tube and between the partitions. An atmosphere side terminal pin projects from the atmosphere side terminal header into the insulating tube, and a liquid side terminal pin projects from the liquid side terminal header. A pin guide surrounds the liquid side terminal pin, and liquid side terminal pin and atmosphere side terminal pin are in electrical contact with each other. An end portion of the pin guide is disposed within an adjacent end portion of the insulating tube.

2 Claims, 6 Drawing Sheets

CABLE CONNECTING AND DISCONNECTING APPARATUS FOR SUBMERGED PUMP

BACKGROUND OF THE INVENTION

This invention relates to a cable connecting and disconnecting apparatus for submerged pumps.

In general, when a submerged pump is installed or removed during the maintenance operation and inspection therefor, the power cable is connected and disconnected.

Referring to FIG. 2 showing an overall view of a submerged pump, a cable connecting and disconnecting apparatus 10 for the submerged pump is provided on an outer side of a submerged pump body 12 and so formed that liquid side and atmosphere side power cables are connected together through an intermediate container 14.

In a conventional cable connecting and disconnecting apparatus 10 as shown in FIG. 1, a reference numeral 14 denotes a cylindrical intermediate container. To opposite ends of this intermediate container 14, the liquid side and atmosphere side terminal headers 15 and 17 are connected by means of the bolts 18 through the covering plates 16 so that the intermediate container 14 may be separated at the liquid side terminal header 15 on the plane A shown in FIG. 1. The interior of the intermediate container 14 is closed airtightly by partitions 20 and 22, and an insulating tube 24 is fixed to one partition 20 and extends to within the other partition 22. A pin 26, one end of which is connected to three atmosphere side power cables, is inserted into the insulating tube 24.

A terminal 32 of the terminal pin 26 inserted into the intermediate container 14 and projecting from the liquid side partition 20 is fixed with a liquid side power cable 30 by means of bolts 33 and is housed in and protected by an insulating tube 28 fixed to an end surface of the liquid side covering plate 16 for the intermediate container 14.

In order to withdraw the submerged pump from the water for the purpose of repairing and inspecting the same, such a conventional cable connecting and disconnecting apparatus 10 is subjected to an operation for disassembling the liquid side and atmosphere side terminal headers. During this operation, the insulating tube 28 is withdrawn until it is completely out of the liquid side terminal header 15 after the bolts 18 with which the intermediate container is fastened to the same terminal header were removed. Before the liquid side power cables 30 connected to the three terminals 32 are removed, the insulating tube 28 must be removed. Finally, the bolt 33 engaged with the terminal 32 at the end of the terminal pin 26 are withdrawn at right angles to the axis of the cable to complete the disassembling operation.

Since an excessively large load is borne by the terminals 32 during this disassembling operation, a centering operation is difficult, with the risk that the terminal pins 26 are likely broken. In order to carry out a terminal header connecting operation, such additional work as the taping of the connected portions to insulate them also becomes necessary. This causes the assembling and disassembling operations to become complicated with an increase of the working steps but with less reliability of the connected portions.

SUMMARY OF THE INVENTION

A first object of the present invention is, therefore, to provide a cable connecting and disconnecting apparatus for submerged pumps with a convenient operation for connecting and disconnecting the cables of the submerged pump improving the reliability of the connected portions, in which an intermediate container is provided between liquid side and atmosphere side terminal headers and an insulating tube is arranged in the intermediate container, a liquid side terminal pin accommodated in a pin guide and an atmosphere side container are housed in the insulating tube when the atmosphere side terminal header is connected to the liquid side terminal header through the intermediate container, and the liquid side and atmosphere side terminal pins are so formed that those pins may be connected to and disconnected from the intermediate container.

To achieve the foregoing objects of the invention, in a cable connecting and disconnecting apparatus for the submerged pump which connects and disconnects a liquid side power cable with an atmosphere side power cable for the submerged pump, there is provided a liquid-tight intermediate container between terminal headers housing therein the liquid side power cable and atmosphere side power cable respectively, the intermediate container is provided therein with a pair of partitions through which an insulating tube is inserted and supported so as to form an air-tight chamber between the partitions, such that when the atmosphere side terminal header is fixed to the end of the intermediate container, an atmosphere side terminal pin which projects from an end portion of the atmosphere side terminal header and which is provided with a connector at the end thereof is housed in the insulating tube, on the other hand the liquid side terminal header is provided at an end portion thereof with a pin guide which houses therein a terminal pin projecting from the end portion of the liquid side terminal header, so that when the intermediate container is connected to the liquid side terminal header, the liquid side pin and the atmosphere side pin connector connected to each other are concurrently housed in the insulating tube where a tulip connector is suitable for the connector.

In the cable connecting and disconnecting apparatus according to the present invention, an intermediate container is provided between liquid side and atmosphere side terminal headers, and an air-tight insulating tube is provided in the intermediate container, a liquid side terminal pin accommodated in a pin guide and the atmosphere side connector are housed in the insulating tube when the atmosphere side terminal header is connected to the liquid side terminal header through the intermediate container, and the liquid side and atmosphere side terminal pins are formed so that those pins may be connected to and disconnected from the intermediate container to facilitate the operations of connecting and disconnecting the cables of the submerged pump and to improve the reliability of the connected portions of the pump.

BRIEF DESCRIPTION OF THE DRAWINGS

Preferred embodiments of a cable connecting and disconnecting apparatus for the submerged pump and a jig therefor according to the present invention will hereinafter be fully described in detail with reference to the accompanying drawings in which.

PREFERRED EMBODIMENTS OF THE INVENTION

Figure 1:
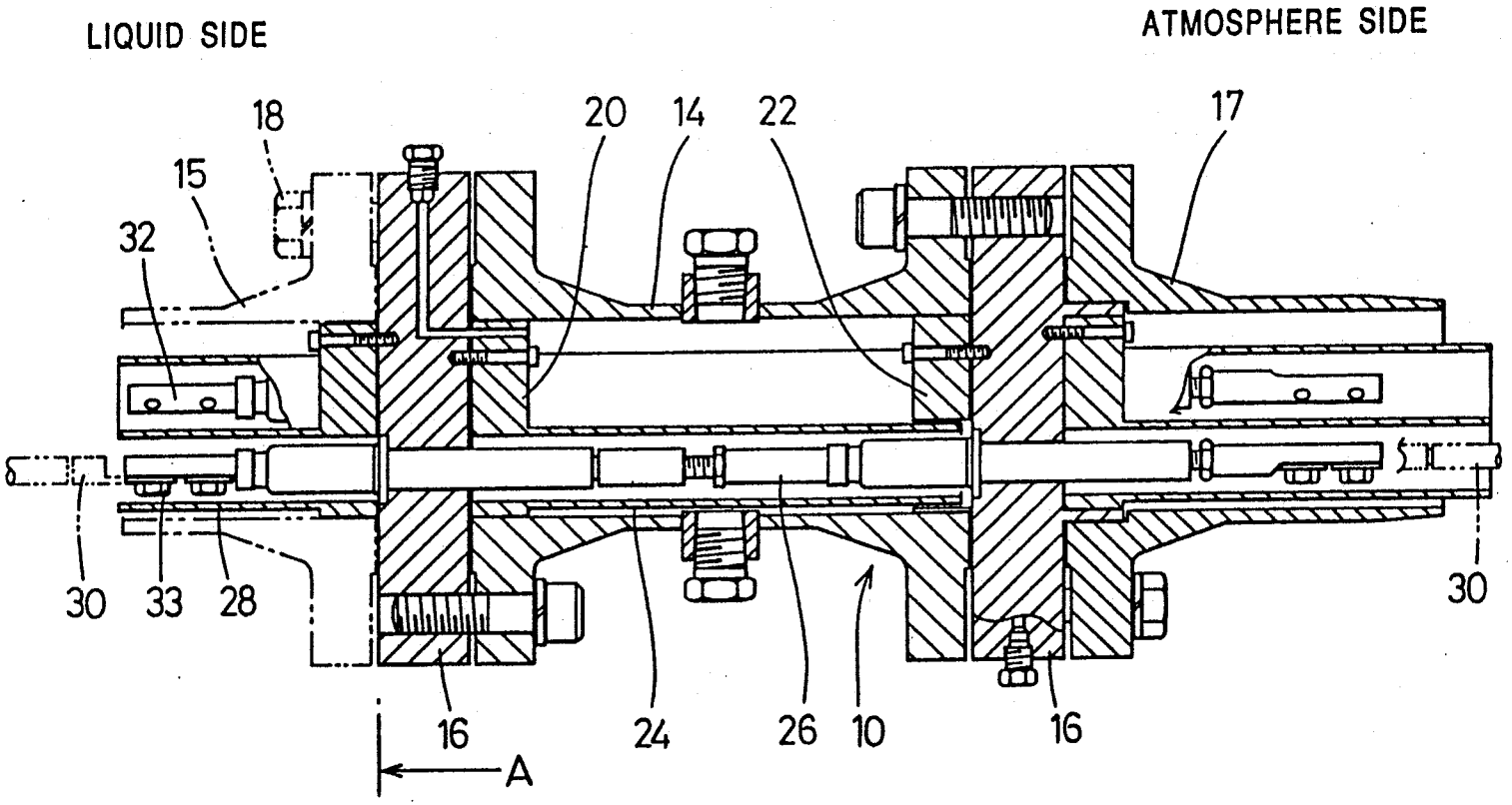
FIG. 1 PRIOR ART
FIG. 1 is a fragmentarily sectioned view of the conventional cable connecting and disconnecting apparatus for a submerged pump.
Figure 2:
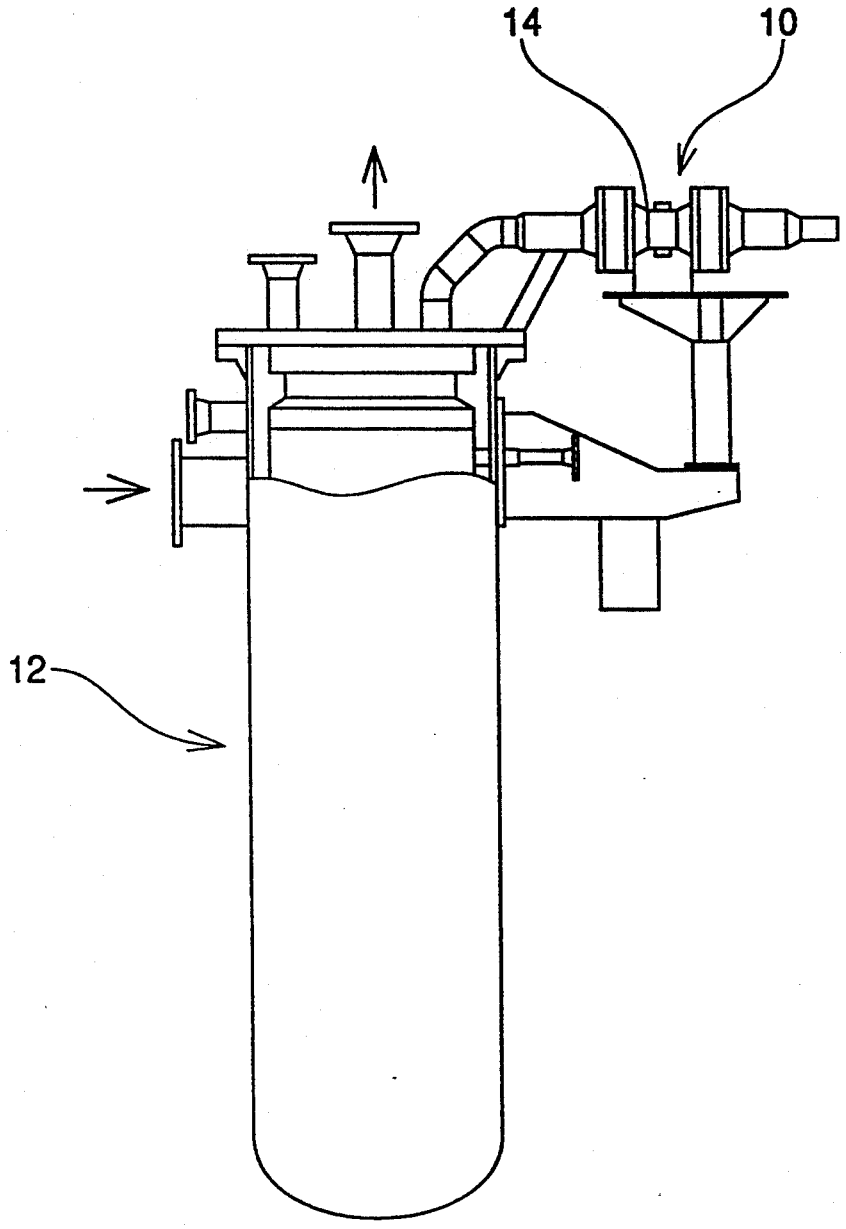
FIG. 2 is a view of a submerged pump with a cable connecting and disconnecting apparatus according to the invention.
Figure 3:
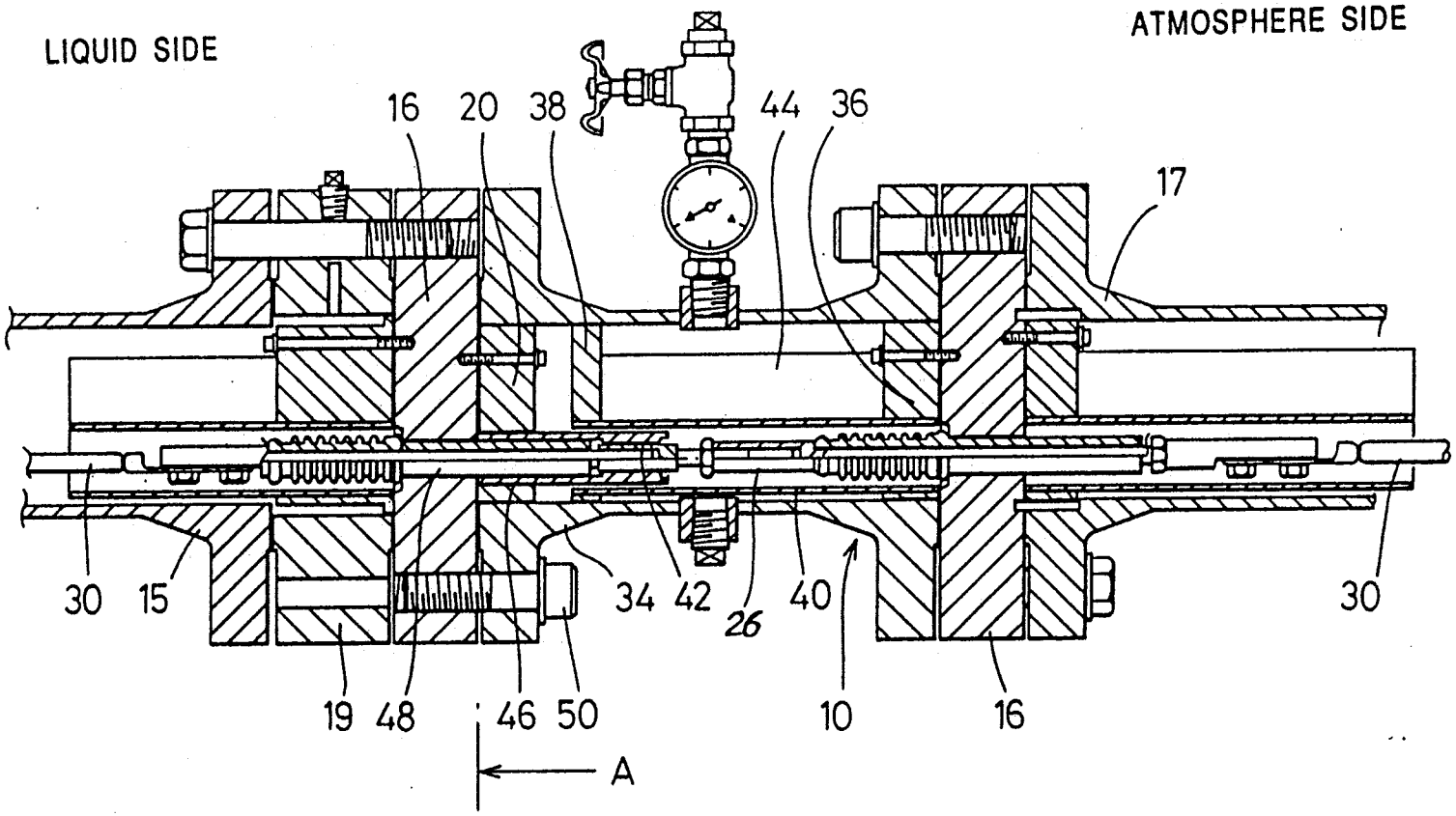
FIG. 3 is a fragmentarily sectioned view showing one embodiment of a cable connecting and disconnecting apparatus for a submerged pump according to the invention, in its connected position.

In FIG. 3, the reference numeral 34 denotes an intermediate container of a cable connecting and disconnecting apparatus 10. In the intermediate container 34, an insulating tube 40 is inserted and supported through a pair of partitions 36 and 38 arranged at the atmosphere side end portion and liquid side and an air-tight chamber 44 is formed between those two partitions 36 and 38. A tulip connector 42 is provided on the end of a terminal pin 26 projecting from the end portion of the atmosphere side terminal header 17 and connected at one end portion thereof to a power cable. When the intermediate container 34 is connected to the end portion of the atmosphere side terminal header 17, the atmosphere side terminal pin 26 projecting therefrom is housed in the insulating tube 40. On the other hand, a covering plate 16 is fixed to an end portion of the liquid side terminal header 15 through a spacer 19. A terminal pin 48 connected to a liquid side power cable is inserted and supported within a tubular pin guide 46 projecting from the covering plate 16.

Figure 3A:
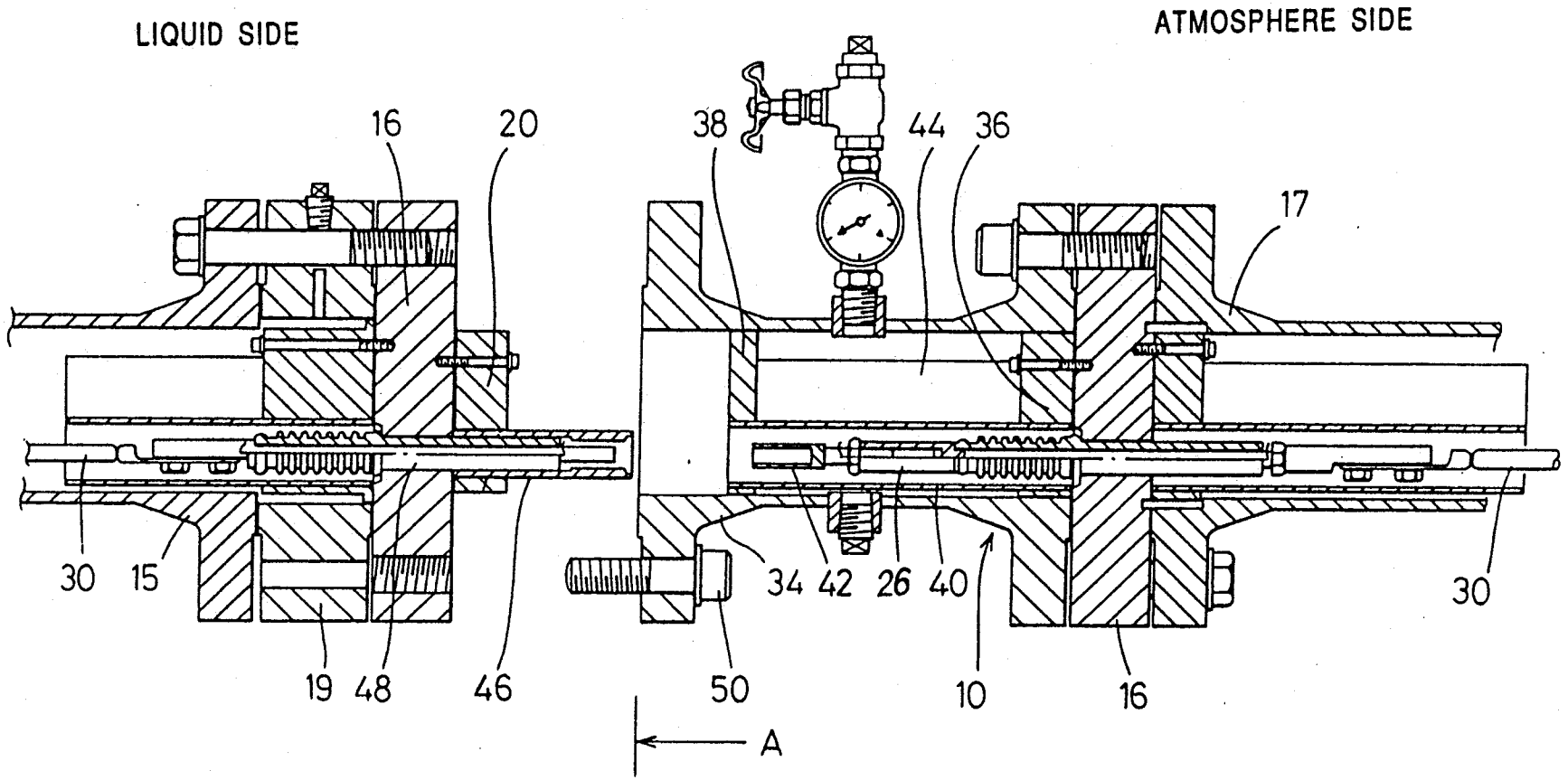
FIG. 3A is a view similar to FIG. 3 but showing the disconnected position.
Figure 4:
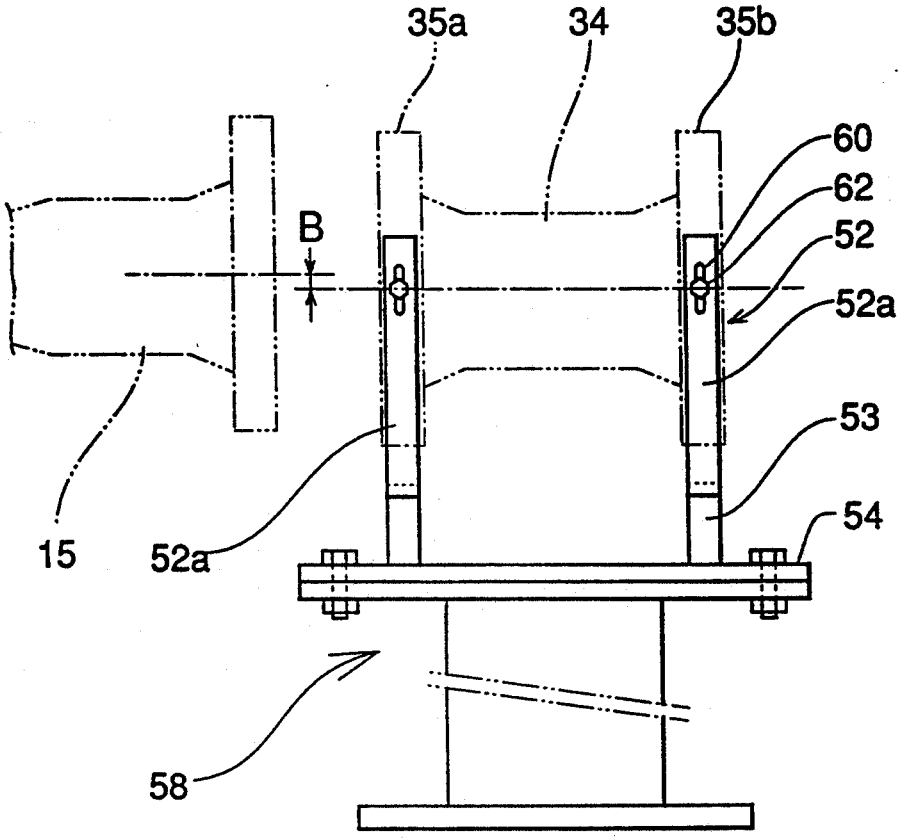
FIGS. 4 and 5 are views showing an embodiment of a jig for a cable connecting and disconnecting apparatus of a submerged pump.
Figure 5:
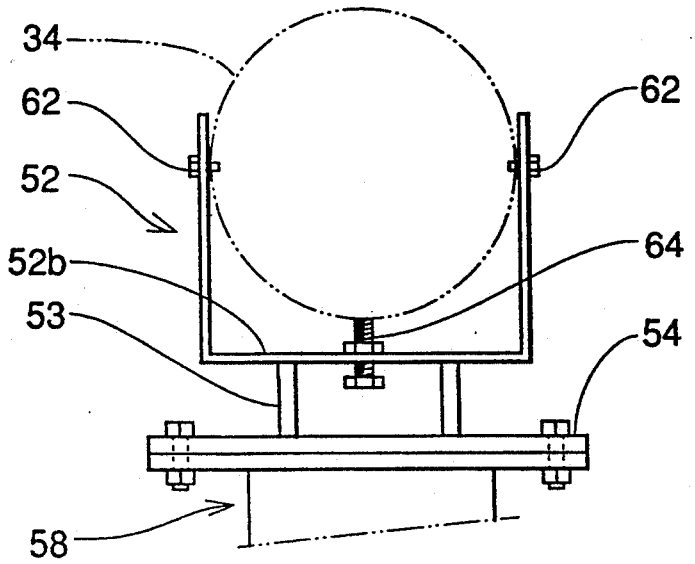

In such a structure of the intermediate container, when the container 34 is connected to the liquid side terminal header 15, the tulip connector 42 is provided at the end of the terminal pin 26 of the atmosphere terminal header 17. The terminal headers are connected to the intermediate container 34, and the tulip connector 42 and the liquid side terminal pin 48 are connected with each other before they are housed within the insulating tube 40 with the pin guide 46 so as to protect the same. Thus, the separating operation of the liquid side and atmosphere side terminal headers 15 and 17 which are connected with each other through the intermediate container 34 may conveniently be performed only by pulling out short time after the bolts 50 are removed. The disconnected position of the parts is shown in FIG. 3A.

Further, the jig for the cable connecting and disconnecting apparatus of the submerged pump is constructed as shown in FIGS. 4 to 7. A base frame 52 is comprised of a pair of side members **52*a* and a bottom member 52*b* which are formed into a U-shape band plate. At least two frames 52 are arranged on the front and rear portions of a base plate 54 through a pair of stand spacers 53 set up thereon. In a pair of the side members 52*a*, there are provided slits 60 with locking bolts 62 adapted to be screwed into holes provided on the outer surface of flanges 35*a* and 35*b* disposed at the opposite ends of the intermediate container 34** in a manner movable in the vertical direction.

Further, jack bolts 64 are provided at the center portion of the bottom members **52*b* of the frames 52 and the jack bolts 64 are made into contact with the bottoms of the flanges 35*a* and 35*b* arranged at the opposite ends of the intermediate container 34 to regulate a vertical position of the intermediate container 34 and to compensate a quantity of deviation B of the intermediate container 34 with respect to an axis of the liquid side terminal header 15**.

The frames 52 supported on a mounting plate 58 are provided so as to move within a predetermined range of the mounting surface of this mounting plate 58, and the intermediate container 34 is moved in the horizontal direction so that an axis of the intermediate container 34 may be regulated in alignment with that of the liquid side terminal header 15.

Figure 6:
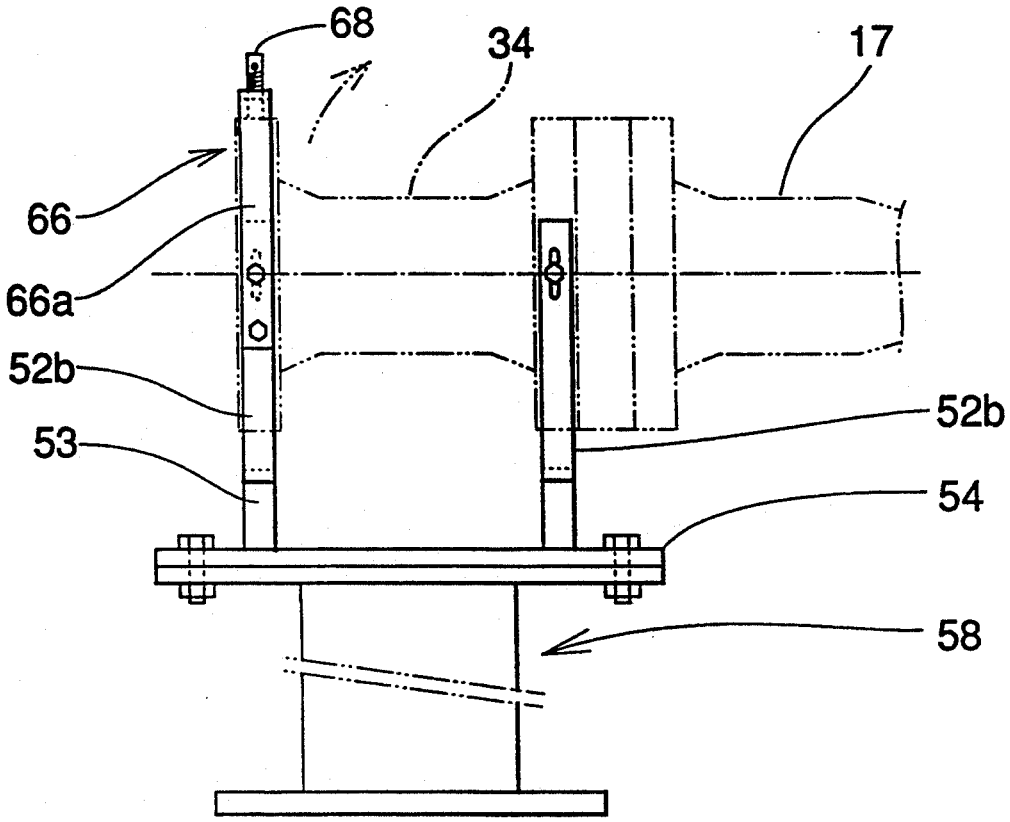
FIGS. 6 and 7 are views showing another embodiment of a jig for a cable connecting and disconnecting apparatus of a submerged pump.
Figure 7:
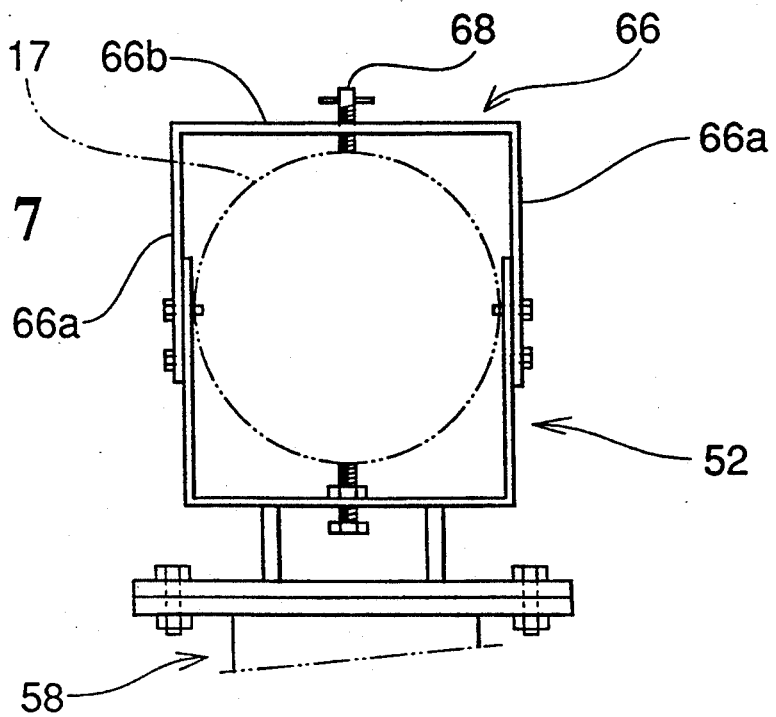

FIGS. 6 and 7 shows a cable connecting and disconnecting jig in which an upper frame is provided on one of the base frames and where a reference numeral 66 denotes an upper frame, which consists of a pair of side members **66*a* and an upper member 66*b* which are formed by bending a band plate into the U-shape, and this upper frame 66 is fixed to the upper portion of a liquid side base frame 52. A screw 68 is provided at the central portion of the upper member 66*b* of the upper frame 66 so as to make the screw into engagement with the upper surface of the intermediate container 34 and hold the container 34. This may prevent, when the atmosphere side terminal header 17 is fixed to the end surface of the intermediate container 34, the intermediate container 34** from inclining in the direction of an arrow due to its own weight.

If two guide bars (not shown) are engaged in parallel with each other with the end surface of the intermediate container 34 or the end surface of the flange of the liquid side terminal header 15, and, if these guide bars are guided with the guide bars engaged with the flange fixing holes in the atmosphere side terminal header 17 or the intermediate container 34, the atmosphere side terminal header 17 or intermediate container 34 may be moved conveniently in the axial disconnecting operation is carried out.

When the jig for the cable connecting and disconnecting apparatus thus formed is used, the tulip connector 42 at the end of the atmosphere side terminal pin 24 may be aligned accurately with the liquid side terminal pin 48, and the power cable connecting and disconnecting operations may be carried out conveniently and safely.

As is clear from the above-described embodiment, the cable connecting and disconnecting apparatus according to the present invention is provided with an intermediate container between liquid side and atmosphere side terminal headers, an insulating tube is provided in this intermediate container, a liquid side terminal pin in a pin guide and an atmosphere side connector are housed in the insulating tube when the atmosphere side terminal header is connected to the liquid side terminal header through the intermediate container, the liquid side and atmosphere side terminal pins are so constructed that those pins may be connected to and disconnected from the intermediate container, enabling a convenient operation for connecting and disconnecting the cables of the submerged pump with improvement of the reliability in the connected portions.

The above is a description of the preferred embodiment of the present invention. The present invention, however, should not be limited to the embodiment shown but may be subject to various design changes within the scope of the present invention.

What is claimed is:

1. A cable connecting and disconnecting apparatus for a submerged pump for connecting and disconnecting a liquid side power cable with an atmosphere side power cable, comprising in combination a liquid side terminal header, an atmosphere side terminal header, a liquid-tight intermediate container detachably secured between said headers, the intermediate container having therein a pair of partitions, an insulating tube disposed within said intermediate container and extending between said partitions and defining with said partitions an air-tight chamber within the intermediate container and outside the insulating tube and between the partitions, an atmosphere side terminal pin projecting from said atmosphere side terminal header into said insulating tube, a liquid side terminal pin projecting from said liquid side terminal header, a pin guide surrounding said liquid side terminal pin, said liquid side terminal pin and atmosphere side terminal pin being in electrical contact with each other, an end portion of said pin guide being disposed within an adjacent end portion of said insulating tube.

2. Apparatus as claimed in claim 1, a free end portion of said liquid side terminal pin interfitting within a hollow adjacent end portion of said atmosphere side terminal pin.

* * * * *